US012459621B1

(12) United States Patent
Fletcher

(10) Patent No.: US 12,459,621 B1
(45) Date of Patent: Nov. 4, 2025

(54) MARINE DRIVES AND APPARATUSES FOR STEERING MARINE DRIVES AND FOR ROUTING FLEXIBLE RIGGING CONNECTORS ON MARINE DRIVES

(71) Applicant: Brunswick Corporation, Mettawa, IL (US)

(72) Inventor: Derek J. Fletcher, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 617 days.

(21) Appl. No.: 17/939,474

(22) Filed: Sep. 7, 2022

(51) Int. Cl.
*B63H 20/12* (2006.01)
*B63H 25/02* (2006.01)

(52) U.S. Cl.
CPC ..... *B63H 20/12* (2013.01); *B63H 25/02* (2013.01); *B63H 2025/024* (2013.01)

(58) Field of Classification Search
CPC ... B63H 20/12; B63H 25/02; B63H 2025/024
See application file for complete search history.

(56) References Cited

U.S. PATENT DOCUMENTS 2,703,989 A 3/1955 Schroeder
4,375,356 A 3/1983 Stevens
4,496,326 A * 1/1985 Boda ..... B63H 20/12 114/144 R
4,739,801 A 4/1988 Kimura
4,969,847 A 11/1990 Curtis et al.
5,007,858 A 4/1991 Daly et al.
5,054,944 A 10/1991 Matsuyama
5,078,629 A 1/1992 Mondek
5,556,310 A 9/1996 Gandarillas
5,637,021 A 6/1997 Watanabe
6,034,326 A 3/2000 Jorgensen
6,093,066 A * 7/2000 Isogawa ..... B63H 20/12 440/86
6,257,940 B1 7/2001 Dunham et al.
6,364,724 B1 4/2002 Nozawa et al.
6,387,002 B1 5/2002 Blase
6,902,450 B2 6/2005 Ohtsuki et al.
(Continued)

FOREIGN PATENT DOCUMENTS

JP H10250688 A * 9/1998 ..... F02B 61/045

OTHER PUBLICATIONS

U.S. Appl. No. 17/880,987, filed Aug. 4, 2022.
(Continued)

*Primary Examiner* — Stephen P Avila
(74) *Attorney, Agent, or Firm* — Andrus Intellectual Property Law, LLP

(57) ABSTRACT

A marine drive may include a frame configured to support the marine drive with respect to the marine vessel, a cowling enclosing a portion of the frame in a cowling interior, a steering arm configured such that movement of the steering arm causes rotation of the marine drive with respect to the steering axis, and a flexible rigging connector extending from the cowling interior to a location in the marine vessel. The flexible rigging connector may extend through a guide passage in the steering arm. Additionally or alternatively, the steering arm may include a base member and a mounting member selectively movable relative to the base member to adjust the length of the steering arm.

20 Claims, 6 Drawing Sheets

(56) References Cited

U.S. PATENT DOCUMENTS

| | | | | |
|---|---|---|---|---|
| 6,960,108 | B1 | 11/2005 | Jaszewski et al. | |
| 7,104,856 | B1 | 9/2006 | Krupp et al. | |
| 7,214,113 | B2 | 5/2007 | Kojima | |
| 7,442,104 | B2 | 10/2008 | Okabe | |
| 7,704,109 | B2 | 4/2010 | Arai et al. | |
| 7,883,385 | B2 | 2/2011 | Sakamoto | |
| 8,658,904 | B2 | 2/2014 | Naganuma et al. | |
| 8,858,280 | B1 | 10/2014 | Wiegele et al. | |
| 9,365,277 | B2 | 6/2016 | Skrzypchak et al. | |
| 9,493,221 | B2 | 11/2016 | Cordell | |
| 9,764,813 | B1 | 9/2017 | Zarembka et al. | |
| 9,783,278 | B1 | 10/2017 | Dannenberg et al. | |
| 9,789,945 | B1 | 10/2017 | Vaninetti et al. | |
| 10,017,136 | B1 * | 7/2018 | Waisanen ..... | B63H 20/32 |
| 10,046,842 | B2 | 8/2018 | Mizutani | |
| 10,202,180 | B1 | 2/2019 | Amerling et al. | |
| 10,246,173 | B1 | 4/2019 | Ingebritson | |
| 10,286,989 | B1 | 5/2019 | Amerling et al. | |
| 10,696,367 | B1 | 6/2020 | Ingebritson et al. | |
| 10,710,691 | B2 | 7/2020 | Amerling et al. | |
| 11,046,405 | B1 | 6/2021 | Groeschel et al. | |
| 11,066,140 | B1 | 7/2021 | Huffer et al. | |
| 11,084,563 | B1 | 8/2021 | Pielow et al. | |
| 11,377,186 | B1 | 7/2022 | Ahlswede et al. | |
| 2004/0083655 | A1 | 5/2004 | Suzuki | |
| 2004/0226737 | A1 | 11/2004 | Ide et al. | |
| 2011/0170733 | A1 | 7/2011 | Aase | |
| 2018/0170501 | A1 | 6/2018 | Gai et al. | |
| 2024/0253912 | A1 | 8/2024 | Tanaka | |

OTHER PUBLICATIONS

U.S. Appl. No. 17/585,214, filed Jan. 26, 2022.

Navy Series Electric Outboard/ePropulsion, https://www.epropulsion.com/navy/?wpmeteordisable=1, accessed Aug. 10, 2022.

Outboard—Cruise 10.0 T—Torqeed, https://www.torqeedo.com/us/en-us/products/outboards/cruise/cruise-10.0-t/M-1243-20.html, accessed Aug. 10, 2022.

Office Action issued in U.S. Appl. No. 18/092,764, dated Jun. 18, 2025.

* cited by examiner

MARINE DRIVES AND APPARATUSES FOR STEERING MARINE DRIVES AND FOR ROUTING FLEXIBLE RIGGING CONNECTORS ON MARINE DRIVES

FIELD

The present disclosure relates to marine drives and particularly to steering arrangements for marine drives having flexible rigging connectors.

BACKGROUND

The following U.S. Patents provide additional background and are incorporated herein by reference.

U.S. Pat. No. 11,377,186 discloses an apparatus for operably connecting a marine drive to a marine vessel. A transom bracket is configured for fixed attachment to the marine vessel and for attachment to the marine drive such that the marine drive is trimmable up and down relative to the marine vessel about a trim axis. The transom bracket has a sidewall with a rigging opening through which at least one elongated rigging member extends for operably connecting the marine drive to the marine vessel, wherein the rigging opening is located along the trim axis. The rigging device has an elbow conduit with an inlet end and an outlet end, wherein the outlet end is positionable into a plurality of clock positions relative to the inlet end.

U.S. Pat. No. 11,046,405 discloses a rigging hose housing provided to couple a rigging hose to a marine vessel. The rigging hose housing includes a radial mounting plate; an outer cylindrical wall extending perpendicularly from the radial mounting plate a first height above a bottom surface of the radial mounting plate; an inner cylindrical wall extending perpendicularly from the radial mounting plate a second height above the bottom surface of the radial mounting plate; and a gutter formed between the inner cylindrical wall and the outer cylindrical wall. The gutter terminates in a drain hole formed in the outer cylindrical wall. The drain hole is configured to permit the expulsion of fluid collected in the gutter from the rigging hose housing.

U.S. Pat. No. 10,710,691 discloses a marine drive including an engine and a cowl having first and second cowl portions. The first cowl portion is movable with respect to the second cowl portion into an open position in which the engine is manually accessible and a closed position in which the engine is enclosed; and a rigging port in the second cowl portion. The rigging port provides a passageway for rigging connectors extending from the engine to a component located remotely from the engine. A rigging opening provides manual access to the rigging connectors and the engine, including when the first cowl portion is in the closed position. A removable access door covers the rigging opening and prevents manual access to the engine and rigging connectors via the rigging opening. The removable access door is fastened to the second cowl portion by a removable fastener that is hidden from view.

U.S. Pat. No. 10,202,180 discloses an outboard motor including an engine coupled in torque-transmitting relationship with a propulsor via a driveshaft. A protective covering for the outboard motor includes a cowl that houses the engine within a closed interior thereof. An opening in an outer surface of the cowl provides access to the closed interior. A rigging tray can be inserted through the opening to a retracted position, in which a majority of the rigging tray is within the closed interior. A plurality of electrical lines extends from the engine and into the rigging tray from a first end thereof. Each electrical line in the plurality of electrical lines terminates in the rigging tray at a respective one of a plurality of electrical connectors. A second end of the rigging tray receives a complementary plurality of vessel electrical lines for connection to the plurality of engine electrical lines via the plurality of electrical connectors.

U.S. Pat. No. 10,017,136 discloses an outboard motor which can be coupled to a transom of a marine vessel via a rigging system. The rigging system includes a plurality of engine-sourced lines extending from an engine of the outboard motor, through an aperture in the motor housing, and to the marine vessel. A protective tube surrounds the plurality of engine-sourced lines and has a first end coupled to the motor housing and a second end coupled to the marine vessel. A rigging center is located aboard the marine vessel and holds distal ends of each of the engine-sourced lines. A plurality of connectors is provided on the distal ends of the engine-sourced lines. At the rigging center, each engine-sourced line is configured to be coupled, via a respective connector, to a corresponding vessel-sourced line. The vessel-sourced lines are in turn connected to respective engine-related devices aboard the marine vessel.

U.S. Pat. No. 7,104,856 discloses a rigging apparatus provided for an outboard motor in which an attachment member is shaped to be rigidly attached to a housing structure, or cowl, of an outboard motor, without the need for additional hardware such as clamps, brackets, or screws. The attachment member is shaped to receive a threaded sleeve in threaded association therewith so that hoses, wires, and cables can be protected within the threaded sleeve. An attachment member of the rigging apparatus is made to be asymmetrical to avoid improper assembly into an opening of the housing structure of an outboard motor.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In examples disclosed herein, a marine drive for propelling a marine vessel in a body of water may include a frame configured to support the marine drive with respect to the marine vessel, a cowling enclosing a portion of the frame in a cowling interior, and a steering arm configured such that movement of the steering arm causes rotation of the marine drive with respect to the steering axis. A flexible rigging connector may extend from the cowling interior to a location in the marine vessel, and the flexible rigging connector may extend through a guide passage in the steering arm.

In examples disclosed herein, an apparatus for steering a marine drive with respect to a marine vessel may include a tiller for manually steering the marine drive with respect to a steering axis and a steering arm for coupling the tiller to the marine drive such that movement of the tiller causes rotation of the marine drive with respect to the steering axis. The steering arm may include a base member configured to be coupled to the marine drive and a mounting member securable to the base member and configured to couple the tiller to the base member. The mounting member may be selectively movable relative to the base member to adjust a position of the tiller relative to the marine drive.

In examples disclosed herein a steering arm for coupling a tiller to a marine drive on a marine vessel may include a base member including mounting openings configured to receive fasteners to couple the steering arm to the marine drive, a mounting member slidably secured to the base member and configured to couple the tiller to the base member, and a guide passage between the base member and mounting member and extending through the steering arm. The guide passage may be configured to support a flexible rigging connector extending from the marine drive to a location on the marine vessel, and the mounting member may be selectively movable relative to the base member to adjust a position of the tiller relative to the marine drive.

BRIEF DESCRIPTION OF THE DRAWINGS

Examples are described with reference to the following drawing figures.

DETAILED DESCRIPTION

During research and development in the field of marine drives, the present inventors determined that rigging connectors extending from a marine drive to a marine vessel are often subject to bending and/or abrasion which may damage the rigging connectors over extended periods of time. Typical rigging members may include but are not limited to hoses, wires, cables, and/or the like, which extend between a marine vessel and a marine drive coupled to the vessel's transom. For example, the electrical system of the marine drive often includes a variety of electrical control and power components. A wiring harness may extend between the marine drive and a helm of the marine vessel. The wiring harness may contain electrical lines that relay digital steering, throttle, and shift commands between the helm and the marine drive. Electrical lines relaying other types of control signals may also be present. Additionally, battery cables may extend between one or more batteries housed within the vessel and terminals provided on the outboard motor. Moreover, in marine drives having an engine, one or more fuel lines may supply fuel to the engine from a fuel tank housed within the vessel. Many marine drives, such as outboard motors, have a tiller for steering. Because the tiller and associated steering arm are usually centered on the marine drive, rigging connectors may need to curve around the tiller and steering arm, which may cause significant movement of the rigging connectors when turning the marine drive. Repetitive movement may cause the connectors to rub against the transom bracket, the transom itself, or other parts of the marine vessel or marine drive support structure resulting in chafing of the connectors.

Moreover, lengthy rigging connectors extending between the marine drive and the marine vessel can affect the styling of the marine drive and can otherwise be inconvenient for a number of reasons. Through research and experimentation, the present inventor determined it would be advantageous to provide features which support rigging connectors extending between the marine drive and the vessel. The present disclosure is a result of the present inventor's efforts in this regard.

Figure 1:
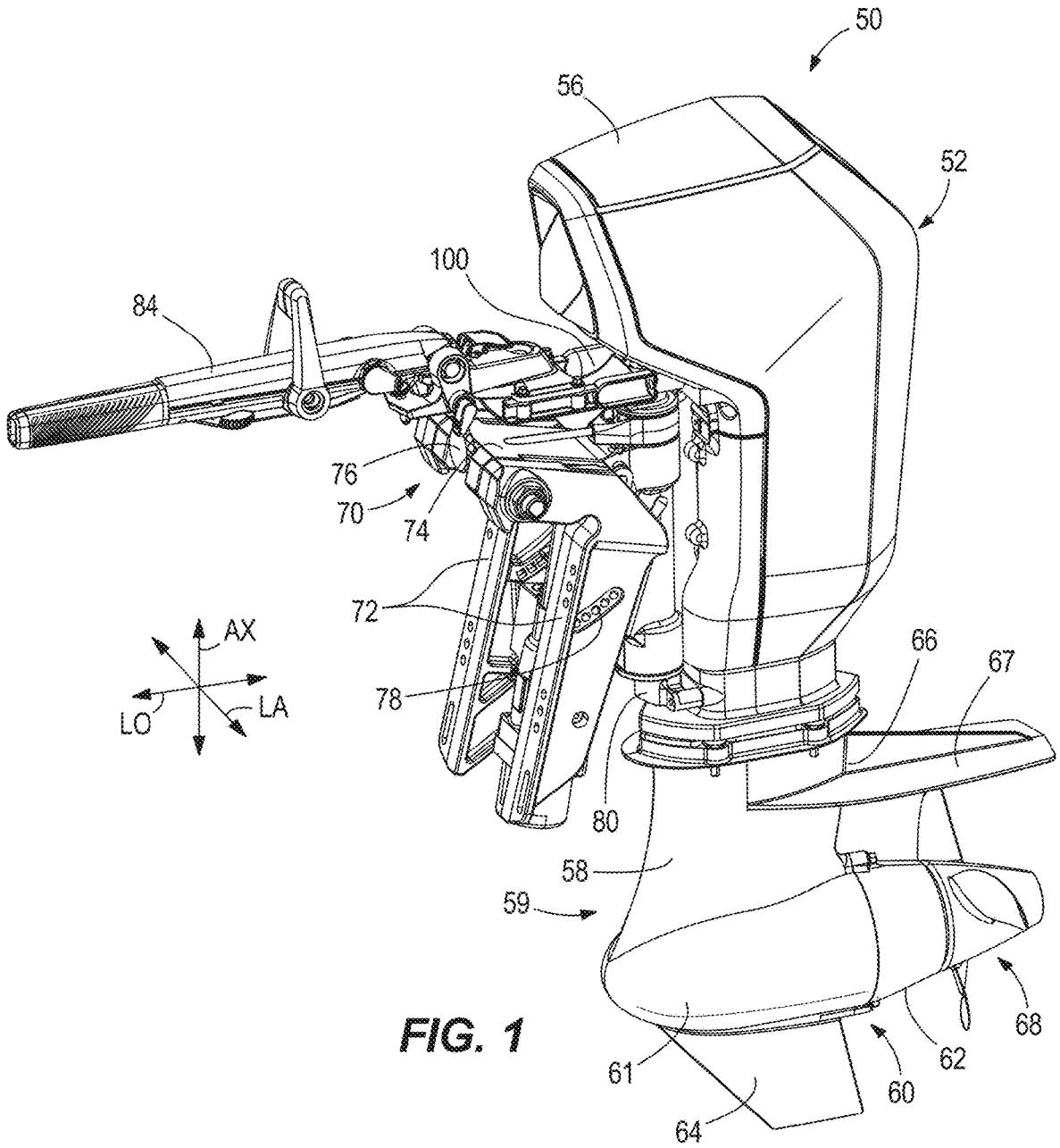
FIG. 1 is a perspective view of a marine drive for propelling a marine vessel with a tiller for steering the marine drive and a transom bracket for mounting the marine drive.
Figure 2:
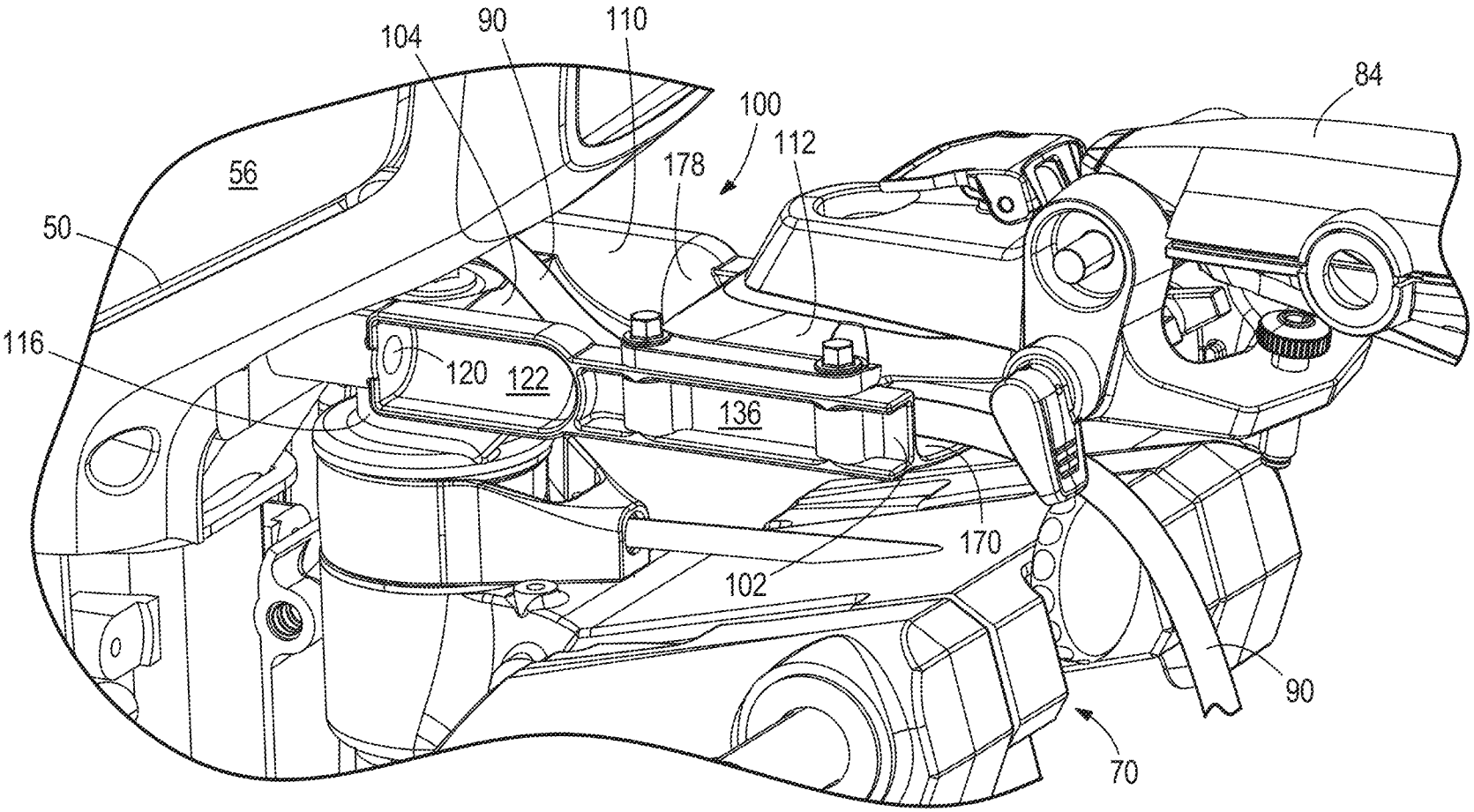
FIG. 2 is a detailed perspective view of the steering arm of the marine drive of FIG. 1.

FIGS. 1 and 2 depicts a marine drive 50 for propelling a marine vessel in a body of water. In the illustrated example, the marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. The marine drive 50 includes an upper portion 52 and a lower portion 54. The upper portion 52 includes a cowling 56 that is fixed to and surrounds most or all of the body of a supporting frame (not shown), as further disclosed in U.S. patent application Ser. No. 17/585,214, the disclosure of which is hereby incorporated herein by reference in entirety. The cowling 56 defines a cowling interior in which a portion of the frame is enclosed and various components of the marine drive 50 are disposed. It should be understood that the various components described above are exemplary and could vary from what is shown.

The lower portion 54 of the marine drive 50 generally includes an extension leg 58 which is coupled to the frame of the upper portion 52 and extends downwardly to a lower housing unit 60. The lower housing unit 60 has a front housing portion 61 and a rear housing portion 62 that are mated together and define a watertight lower housing cavity. The front housing portion 61 has a nosecone with a smooth outer surface which transitions to the upwardly extension leg 58 and a downwardly extending skeg 64. An anti-ventilation plate 66 is positioned between an upper end and a lower end of the extension leg 58 and includes a flat tail 67 that extends rearwardly from the extension leg 58. A conventional propulsor 68 is mounted on the outer end of the propulsor shaft extending from the lower housing unit 60 such that rotation of the propulsor shaft causes rotation of the propulsor 68, which in turn generates a thrust force for propelling the marine vessel in water. The type and configuration of the propulsor can vary, and for example can include one or more propellers, impellers, and/or the like.

A transom bracket 70 is configured to mount the marine drive 50 to the transom of the marine vessel. The type and configuration of the transom bracket 70 can vary from what is shown. In the illustrated example, the transom bracket 70 includes a pair of clamp brackets 72 and a swivel bracket 74 located between the clamp brackets 72. The clamp brackets 72 are configured to be fixedly coupled to the transom. The swivel bracket 74 is pivotable with respect to the clamp brackets 72 about a pivot shaft 76 that laterally extends through the forward upper ends of the clamp brackets 7, thereby defining a trim axis. Pivoting of the swivel bracket 74 about the pivot shaft 76 trims the marine drive 50 relative to the marine vessel, for example out of and/or back into the body of water in which the marine vessel is operated. A selector bracket 78 having holes is provided on at least one of the clamp brackets 72. Holes respectively become aligned with a corresponding mounting hole on the swivel bracket 74 at different selectable trim positions for the marine drive 50. A selector pin (not shown) can be manually inserted into the aligned holes to thereby lock the marine drive 50 in place with respect to the trim axis, all as is conventional.

With continued reference to FIGS. 1 and 2, the marine drive 50 is supported on the swivel bracket 74 by a steering arm 100 (see FIG. 2) and a not-shown steering tube which is fixed to the steering arm 100 and seated in a swivel cylinder 80 of the swivel bracket 74. The marine drive 50 can be steered left or right relative to the marine vessel by rotating about a steering axis defined by the steering tube and swivel cylinder 80, via a manually operable tiller 84 secured to a forward end 102 of the steering arm 100. The illustrated tiller 84 is a conventional item, and the type and configuration of the tiller 46 can vary from what is shown. Suitable examples of a tiller 84 are disclosed in U.S. Pat. Nos. 10,246,173; 9,789,945; and 9,783,278; which are also incorporated herein by reference. Note however that many of the concepts of the present disclosure are not limited for use with marine drives having tiller arms, and in fact could be implemented in marine drives which do not have a tiller arm and/or have automatic steering systems or any other known apparatus for steering a marine drive with respect to a marine vessel.

As illustrated in FIG. 2, steering arm 100 is fixedly coupled to and extends forwardly from the upper portion 52 of the marine drive 50, towards the transom of the marine vessel. The steering arm 100 has a forward end 102 connected to the tiller 84 and an opposite, aftward end 104 which is resiliently coupled the upper portion 52 of the marine drive 50.

Figure 3:
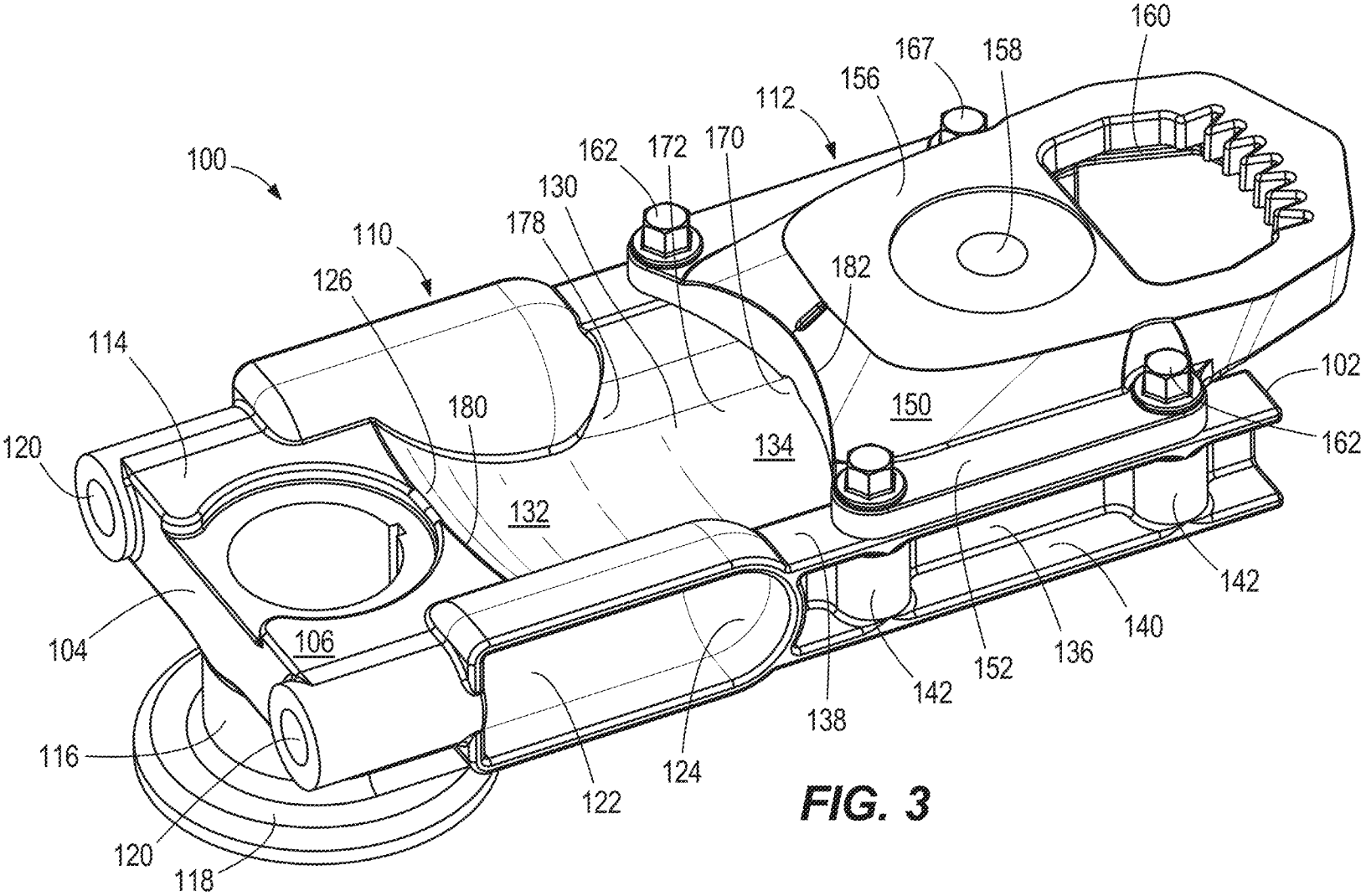
FIG. 3 is a perspective view of the steering arm of FIG. 2.
Figure 4:
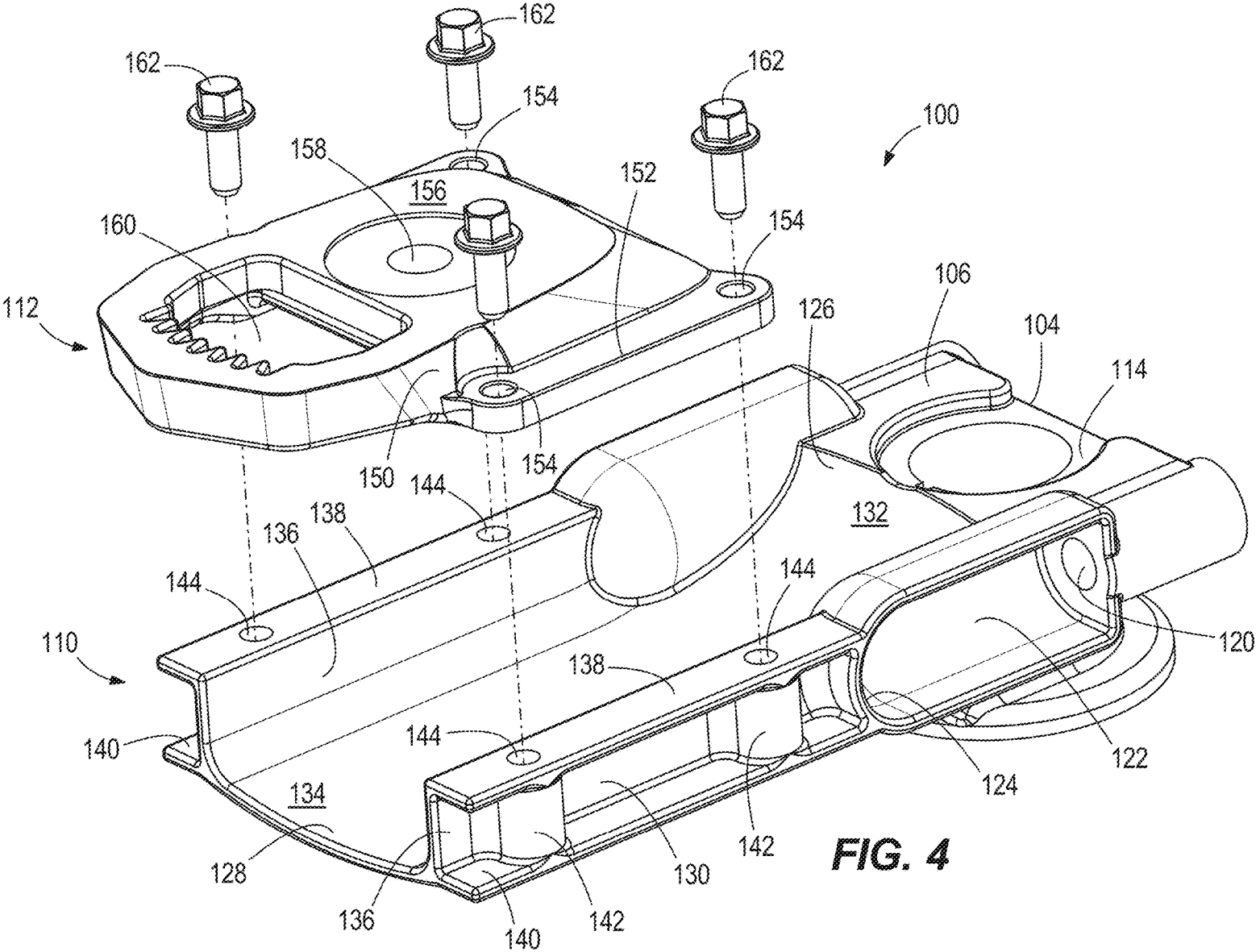
FIG. 4 is an exploded view of the steering arm of FIG. 3.

Referring to FIGS. 3 and 4, the steering arm 100 includes a base member 110 and a mounting member 112 coupled to the base member 110 proximate the forward end 102 of the steering arm 100. The base member 110 includes a body portion 114 positioned at the aftward end 104 of the steering arm 100. A generally cylindrical hub 116 protrudes downwardly from the body 114 and includes an annular flange 118 extending circumferentially around a lower end of the hub 116. The cylindrical hub 116 is configured to connect to the noted steering tube and support the marine drive 50 on the swivel bracket 74. Mounting holes 120 are formed in opposite lateral sides of the body 114 and extend longitudinally from the aftward end 104 to recesses 122 formed into the lateral sides of the base member 110. The recesses 122 each open laterally outward and are configured to provide clearance for a fastener (not shown) to be inserted into the mounting holes 120 via the recesses 122.

A support tray 130 is positioned beneath the mounting member 112 and extends in a forward longitudinal direction from the body 114 of the base member 110. The rear end 126 of the support tray 130 includes a sloped section 132 that curves downward from an upper surface 106 of the body 114. The sloped section 132 smoothly transitions to a generally planar section 134 of the support tray 130, which extends to the forward end 102 of the steering arm 100 and provides a front end of the support tray 130. Side walls 136 project upward from the lower surface of the support tray 130. The side walls 136 extend along the lateral sides of the support tray 130 from the front ends 124 of the recesses 122 to the forward end 102. Each side wall 136 includes a generally horizontal upper plate 138 and a generally horizontal lower plate 140 spaced vertically apart from the upper plate 138. The upper plate 138 is positioned at an upper edge of the side wall 136 and a the lower plate 140 is positioned at a lower edge of the side wall 136. In the illustrated example, each side wall 136 includes two columns 142 that extend between the upper plate 138 and the lower plate 140. A vertically oriented bore 144 is formed through each column 142 from the upper plate 138 to the lower plate 140. Some examples, however, may omit at least one of the columns and include a side wall with two concentric bores formed through the upper and lower plates.

With continued reference to FIGS. 3 and 4, the mounting member 112 includes a rigid body 150 with mounting flanges 152 extending along opposite lateral sides of the body 150. Bores 154 extend vertically through each of the mounting flanges 152 and are positioned so that each bore 154 in the mounting flange 152 is aligned with a corresponding one of the bores 144 in the base member 110. Fasteners 162 are inserted through each bore 154 in the mounting flange 152 and engage the corresponding one of the bores 144 in the base member 110 to secure the mounting member 112 to the base member 110. The body 150 of the mounting member 112 provides a pedestal 156, and a through-bore 158 extends through the center portion of the pedestal 156. A cutout 160 extends through the pedestal 156 proximate a forward end of the mounting member 112. The cutout 160 is four-sided and has an engagement side which includes a plurality of triangular engagement. The through-bore 158 and the cutout 160 are configured for securing a tiller 84 to the mounting member 112. For example, the illustrated through-bore 158 and the cutout 160 are configured for securing an angularly adjustable tiller to the steering arm 100, as described in U.S. patent application Ser. No. 17/880,987, the entire contents of which are hereby incorporated by reference. It should be understood that the various components described above are exemplary and some examples may be configured with alternative tiller mounting features.

As previously mentioned, examples of the novel steering arm may include features configured to reduce the wear on wires, cables, and/or other rigging connectors that extend between a marine drive and the marine vessel. In the illustrated examples, for example, the steering arm 100 includes a guide passage 170 which extends through the steering arm 100. The guide passage 170 is configured to support a flexible rigging connector 90 extending between the marine drive 50 and a remote location on the marine vessel.

Figure 5:
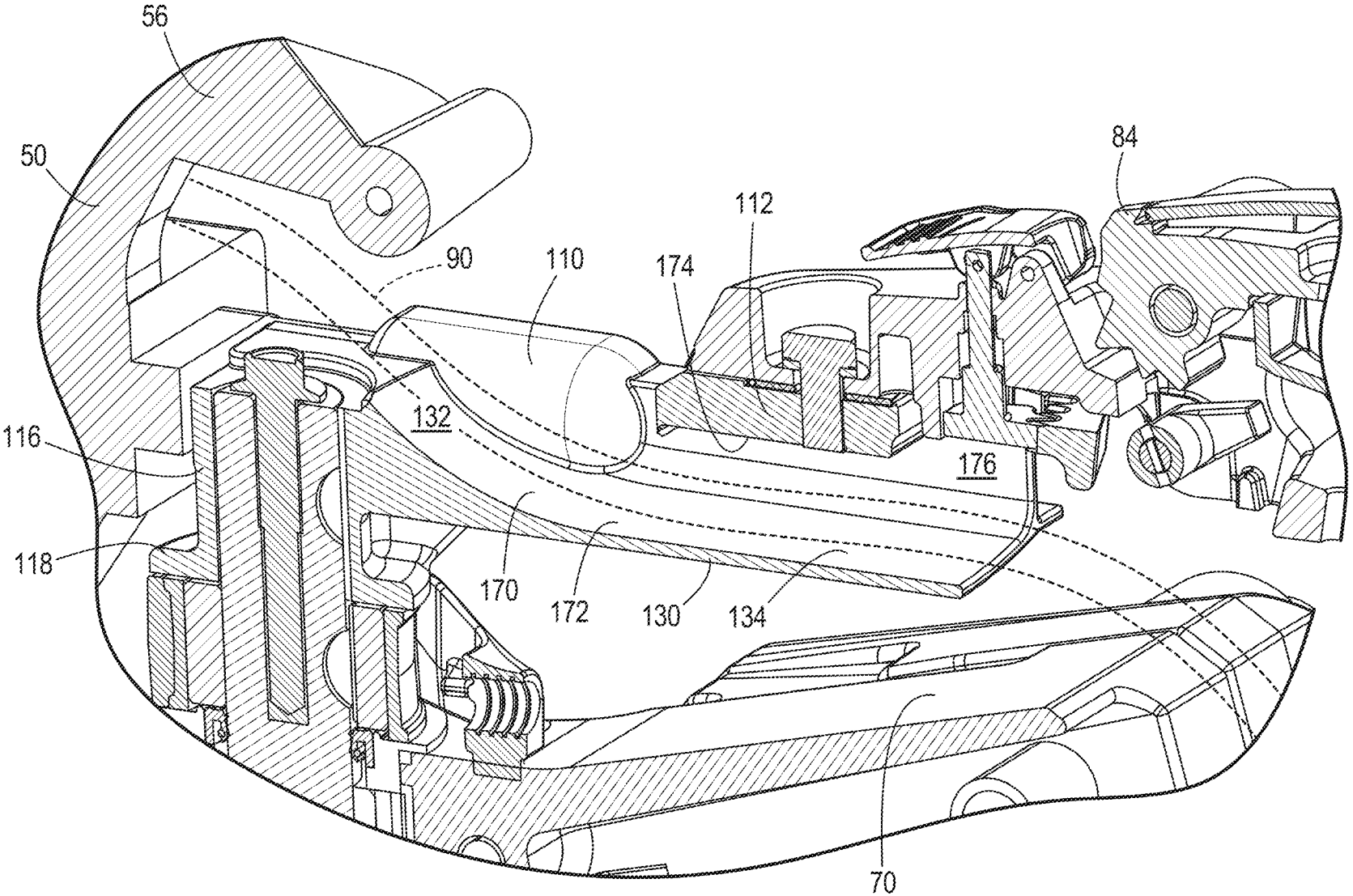
FIG. 5 is a cross sectional view of the marine drive and steering arm of FIG. 2 with a flexible rigging connector extending through a guide passage the steering arm.

Referring to FIGS. 3 and 5, the guide passage 170 extends through the steering arm 100 in a space between the base member 110 and the mounting member 112. The sloped section 132 and the planar section 134 of the support tray 130 provide a lower surface 172 of the guide passage 170. The mounting member 112 provides an upper surface 174 of the guide passage 170 over the planar section 134 of the support tray 130. The side walls 136 of the support tray 130 project upwardly from the lower surface 172 of the guide passage 170 to define lateral sides 176 of the guide passage 170. An entrance opening 178 into the guide passage 170 is generally provided between the front edge 180 of the body 114 of the base member 110 and a rear edge 182 of the mounting member 112. In the illustrated example, both the front edge 180 and the rear edge 182 have a convex curvature which provides additional clearance for the flexible rigging connector 90. Other examples, however, may be configured with a guide passage having a differently shaped opening.

As illustrated in FIGS. 2 and 5, the flexible rigging connector 90 extends out of the cowling 56 at a generally central location above the hub 116 of the steering arm 100. In the illustrated examples, the flexible rigging connector 90 includes a plurality of wires which are bundled into a single cable. Some examples, however, may include a plurality of separate wires, cables, fuel lines, and any other rigging connectors extending from the marine drive 50 to the marine vessel. From its outlet on the cowling 56, the flexible rigging connector 90 slopes downward into the guide passage 170 through the entrance opening 178. The support tray 130, which provides the lower surface 172 of the guide passage 170, extends over a portion of the transom bracket 70 thereby supporting the flexible rigging connector 90 and spacing it apart from the transom bracket 70. By supporting the flexible rigging connector 90 and holding it above the transom and transom bracket 70, the steering arm 100 prevents the flexible connecter 90 from rubbing against the upper surfaces of the transom and transom bracket 70, thereby reducing wear on the flexible rigging connector 90. The support tray 130 routes the flexible rigging connector 90 to the forward end 102 of the steering arm 100, where the flexible rigging connector 90 exits the guide passage 170 below the tiller 84. This may be useful, for example to provide a direct route for the flexible rigging connector 90 to the desired endpoint in the marine vessel while concealing the flexible rigging connector 90 beneath the tiller 84.

Figure 6:
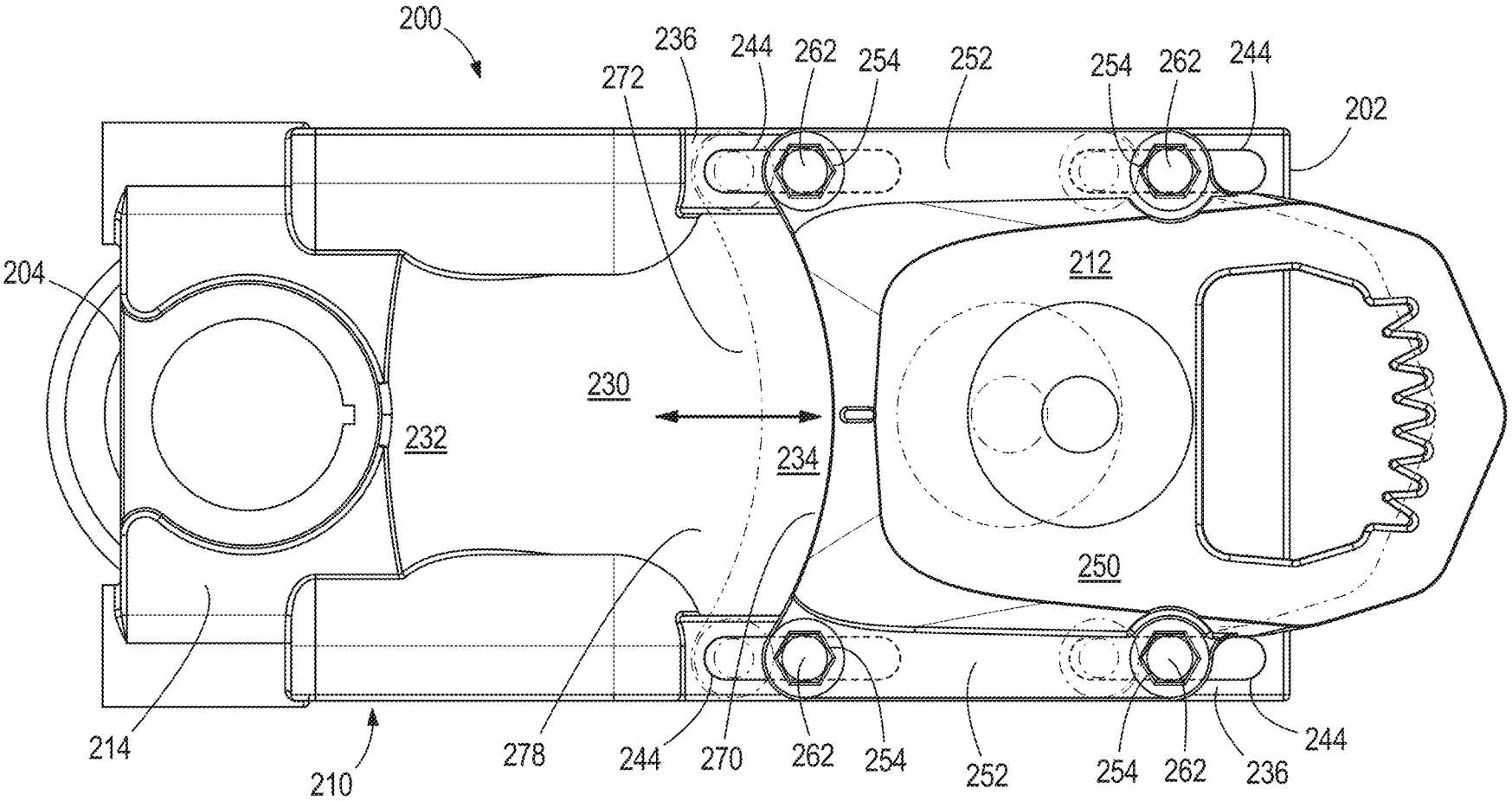
FIG. 6 is a top view of an example of an adjustable steering arm.

In the examples of FIGS. 1-5, the mounting member 112 of the steering arm 100 is rigidly secured to the base member 110. Some examples of a steering arrangement, however, may include an adjustable steering arm. For example, FIG. 6 illustrates an example of a steering arm 200 that is adjustable in length. The steering arm 200 includes a mounting member 212 that is slidably secured the base member 210 and a guide passage 270 extending through the steering arm 200. The base member 210 includes a support tray 230 with side walls 236 and longitudinally oriented slots 244 formed through the side walls 236. Each slot 244 corresponds to one of the bores 254 formed in the mounting flanges 252 of the mounting member 212. A fastener 262 simultaneously engages each bore 254 and a corresponding one of the slots 244 to slidably couple the mounting member 212 to the base member 210. In the illustrated example, the base member 210 includes two slots 244 formed in each lateral side wall 236. Some examples, however, may include at least one side wall with a single slot that can be simultaneously engaged by fasteners extending through two adjacent bores in a mounting flange of the mounting member.

To secure the position of the mounting member 212 on the base member 210, the fasteners 262 can be tightened to restrict movement of the mounting member 212 relative to the base member 210 and lock the mounting member 212 in place. Loosening the fasteners 262 unlocks the mounting member 212 and allows it to slide longitudinally on the base member 210. When a tiller 84 is coupled to the mounting member 212 (see FIGS. 1 and 2), movement of the mounting member 212 adjusts the position of the tiller 84 relative to the marine drive 50. Sliding the mounting member 212 in a first longitudinal direction away from the aftward end 204 of the steering arm 200 increases the length of the steering arm 200, effectively increasing the reach of a tiller connected thereto. This may be useful, for example, so that a user may operate the tiller from a greater distance away from the marine drive, and to reduce the force needed to turn the marine drive with the tiller by increasing the length of the moment arm. Movement of the mounting member 212 in the first longitudinal direction also increases the size of the entrance opening 278 into the guide passage 270, which may be useful to accommodate a large flexible rigging connector 90 or a plurality of flexible rigging connectors. Sliding the mounting member 212 in an opposite, second longitudinal direction towards from the aftward end 204 of the steering arm 200 decreases the length of the steering arm 200 and the reach of a connected tiller. This may be useful, for example, in order to reduce the space required to operate the tiller by reducing the radius of its turning arc. Movement of the mounting member 212 in the second direction also decreases the size of the entrance opening 278 into the guide passage 270.

While the illustrated example of an adjustable steering arm 200 includes slots 244 formed in the base member 210 and bores 254 formed in the mounting member 212, some examples may be differently configured. For example, a steering arm may include a mounting member with slots formed in its mounting flanges and corresponding bores formed in the side walls of the base member. Further still, some examples may be configured with mounting slots formed in both the base member and the mounting member. In other examples, the adjustable steering arm and/or mounting member includes a series of mounting bores instead of or in addition to the slots 244, facilitating length adjustment. Further still, a clamping member or guide member can be provided in the guide passage for retaining the flexible rigging connectors, for example providing strain relief and/or radial positioning and retaining of the rigging connectors relative to each other. Reference is also made to U.S. Pat. No. 11,377,186 providing an example guide member for retaining flexible rigging connectors.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine drive for propelling a marine vessel in a body of water, the marine drive comprising:

a frame configured to support the marine drive with respect to the marine vessel;

a cowling enclosing a portion of the frame in a cowling interior;

a steering arm configured to support a tiller relative to the marine drive; and a flexible rigging connector extending from the cowling interior and through the steering arm for connecting a component of the marine drive to a component on the marine vessel.

2. The marine drive according to claim 1, further comprising a guide passage extending through the steering arm, the guide passage configured to support the flexible rigging connector in the steering arm.

3. The marine drive according to claim 2, further comprising a transom bracket configured to support the marine drive relative to the marine vessel, wherein the guide passage keeps the flexible rigging connector spaced apart from the transom bracket.

4. The marine drive according to claim 1, further comprising a tiller coupled to the steering arm, wherein the flexible rigging connector from the steering arm below the tiller for connection to the component on the marine vessel.

5. The marine drive according to claim 4, wherein the flexible rigging connector extends from the steering arm at a location below the tiller.

6. The marine drive according to claim 1, wherein the steering arm has a length that is adjustable.

7. The marine drive according to claim 1, wherein the steering arm further comprises:

a base member configured to be coupled to the marine drive; and a mounting member coupled to the base member, the mounting member being configured to couple a tiller to the base member;

wherein a guide passage for the flexible rigging connector is between the base member and the mounting member.

8. The marine drive according to claim 7, wherein the mounting member is selectively movable relative to the base member to adjust a size of an opening through which the flexible rigging connector enters the guide passage.

9. An apparatus for steering a marine drive with respect to a marine vessel, the apparatus comprising:

a tiller for steering the marine drive; and a steering arm for coupling the tiller to the marine drive such that movement of the tiller steers the marine drive, the steering arm including a base member configured to be coupled to the marine drive and a mounting member configured to couple the tiller to the base member;

wherein the mounting member is selectively movable relative to the base member to adjust a position of the tiller relative to the marine drive.

10. The apparatus according to claim 9, wherein the mounting member is slidably coupled to the base member.

11. The apparatus according to claim 9, further comprising a bore formed through a first one of the mounting member and the base member, a slot formed through a second one of the mounting member and the base member, and a fastener extending through the slot and engaged with the bore to couple the mounting member to the base member.

12. The apparatus according to claim 11, wherein loosening the fastener allows the mounting member to slide relative to the base member, and wherein tightening the fastener restricts sliding movement of the mounting member relative to the base member.

13. The apparatus according to claim 9, wherein the mounting member is selectively movable in a first longitudinal direction to increase a length of the steering arm, and wherein the mounting member is selectively movable in a second longitudinal direction opposite the first longitudinal direction to decrease the length of the steering arm, thereby decreasing the length of the steering arm.

14. The apparatus according to claim 9, wherein the steering arm comprises a guide passage through the steering arm between the base member and the mounting member, the guide passage being configured to receive a flexible rigging connector extending from the marine drive for connection to a component on the marine vessel.

15. The apparatus of claim 9, wherein the base member comprises a support tray positioned beneath the mounting member, the support tray being configured to support a flexible rigging connector extending from the marine drive for connection to a component on the marine vessel.

16. The steering arm according to claim 15, wherein the support tray is configured to route the flexible rigging connector below the tiller.

17. A steering arm for coupling a tiller to a marine drive on a marine vessel, the steering arm comprising:

a base member including mounting openings configured to receive fasteners to couple the steering arm to the marine drive;

a mounting member slidably secured to the base member and configured to couple the tiller to the base member; and a guide passage between the base member and mounting member and extending through the steering arm, the guide passage being configured to support a flexible rigging connector extending from the marine drive for connection to a component on the marine vessel;

wherein the mounting member is selectively movable relative to the base member to adjust a position of the tiller relative to the marine drive.

18. The steering arm according to claim 17, wherein moving the mounting member in a first longitudinal direction increases a length of the steering arm and a size of an opening into the guide passage and moving the mounting member in an opposite, second longitudinal direction decreases the length of the steering arm and the size of the opening into the guide passage.

19. The steering arm according to claim 17, further comprising a support tray extending along a lower surface of the guide passage, the support tray configured to support the flexible rigging connector.

20. The steering arm according to claim 19, wherein the base member comprises side walls extending along opposite lateral sides of the support tray, and wherein the mounting member is coupled to the side walls of the base member.

* * * * *